US005125788A

United States Patent [19]

Stenger

[11] Patent Number: 5,125,788

[45] Date of Patent: Jun. 30, 1992

[54] QUICK-CHANGE SYSTEM

[75] Inventor: Reinhard Stenger, Stuttgart, Fed. Rep. of Germany

[73] Assignee: Dr. Ing. h.c.F. Porsche AG, Fed. Rep. of Germany

[21] Appl. No.: 676,268

[22] Filed: Mar. 25, 1991

[30] Foreign Application Priority Data

Mar. 30, 1990 [DE] Fed. Rep. of Germany ..... 4010224

[51] Int. Cl.[5] ..... E02F 3/28

[52] U.S. Cl. ..... 414/723; 92/28

[58] Field of Search ..... 414/723, 686; 92/28, 92/27; 91/43, 42; 292/144, 33; 172/273

[56] References Cited

U.S. PATENT DOCUMENTS

| | | | |
|---|---|---|---|
| 2,267,644 | 12/1941 | Ernst et al. | 91/28 |
| 3,033,171 | 5/1962 | Engelbrecht et al. | 92/27 X |
| 4,373,852 | 2/1983 | Maurer | 414/723 |
| 4,674,945 | 6/1987 | Hulden | 414/723 |

FOREIGN PATENT DOCUMENTS

| | | |
|---|---|---|
| 0273828 | 7/1988 | European Pat. Off. . |
| 1784323 | 8/1971 | Fed. Rep. of Germany . |
| 9001617.3 | 4/1990 | Fed. Rep. of Germany . |
| 2304726 | 10/1976 | France . |
| 2132584 | 7/1984 | United Kingdom . |

OTHER PUBLICATIONS

Two-page European Search Report, EP 90122462, Jun., 1991.

*Primary Examiner*—Robert J. Spar
*Assistant Examiner*—Donald W. Underwood
*Attorney, Agent, or Firm*—Evenson, Wands, Edwards, Lenahan & McKeown

[57] ABSTRACT

A quick-change arrangement for an excavator is provided for the exchange of tools which are detachably fastened by way of locking elements to an adapter of a bending arm and held on the bending arm so that the tool can be swivelled around a horizontal axis. The locking elements comprise a piston, which is coaxially arranged in a housing and has end-side locking pins which, by way of an interposed pressure spring, can be adjusted into a moved-out operative position and, by way of a pressure admission controlled by the control unit, can be adjusted into a moved-in inoperative position inside the adapter. By this construction of the device, it is achieved that the locking pins are subjected to the tension of the pressure spring in the operative position.

11 Claims, 6 Drawing Sheets

QUICK-CHANGE SYSTEM

BACKGROUND AND SUMMARY OF THE INVENTION

The invention relates to a quick-change system for an excavator for the exchange of tools which are detachably fastened to an adapter of a bending arm by way of locking means and are held on the bending arm so that they can be swivelled around a horizonal axis.

From the German Patent Document DE-A 17 84 323, a quick-coupling system is known for connecting a tool with a bucket loader which comprises a pair of pins which can be engaged and disengaged with bores of the tool. The pins are operated by way of rods and reversing levers which are connected with a compressed-air cylinder. An arrangement of this type requires a relatively large amount of space, and the forces to be applied for adjusting the pins ar relatively high.

It is an object of the invention to provide a quick-change system which can be mounted in a space-saving manner on the bending arm as a structural unit, has a stable construction, and ensures a reliable connection between the tool and the bending arm.

According to the invention, this object is achieved by providing an arrangement wherein the locking means comprise piston means coaxially arranged in a housing and end-side locking pin means which, by way of an interposed pressure spring, can be adjusted into a moved-out operative position and, by way of a pressure admission controlled by a control unit, can be adjusted into a moved-in inoperative position inside the adapter.

The principal advantages achieved by the invention are that the locking pins are in a locking position as a result of an interposed single pressure spring, and the locking pins or the pistons of the locking pins are correspondingly acted upon by pressure only for the adjustment into an inoperative position (unlocked position). This ensures that the system in the locking position is solely subjected to the tension of the pressure spring and thus, when the pressure circuit fails, this position is nevertheless not endangered.

The locking elements, which consist of coaxially arranged pistons with locking pins in a cylindrical housing, are to be housed in an adapter in a space saving manner and can be dimensioned corresponding to the requirements with respect to the absorption of forces and moments. In particular, the hydraulic control circuit is designed such that a moving-back of the pistons can take place against the tension of the pressure spring. In order to promote the spring tension, according to another embodiment, the pistons can be acted upon by pressure also in the operating direction of the pressure spring.

According to the requirements of respective preferred embodiments, a structural unit may be used which consists of one pair of pistons with two locking pins or of two pairs of pistons with four locking pins.

The coaxial arrangement of the two pistons with the axial position of the pressure spring between the pistons results in a small compact structural unit which can be housed in the adapter in a simple manner and can easily be mounted and removed.

The adjustment of the pistons takes place by way of an operable multiple-way valve of the control unit which can be adjusted manually or electrically by means of a switch.

In the case of a construction of the quick-change system with only one locking element, the tool to be connected with the bending arm is hung in on the adapter. For this purpose, the adapter comprises a hook which, in a form-fitting manner, reaches around a cam of the tool.

Other objects, advantages and novel features of the present invention will become apparent from the following detailed description of the invention when considered in conjunction with the accompanying drawings.

DETAILED DESCRIPTION OF THE DRAWINGS

Figure 1:
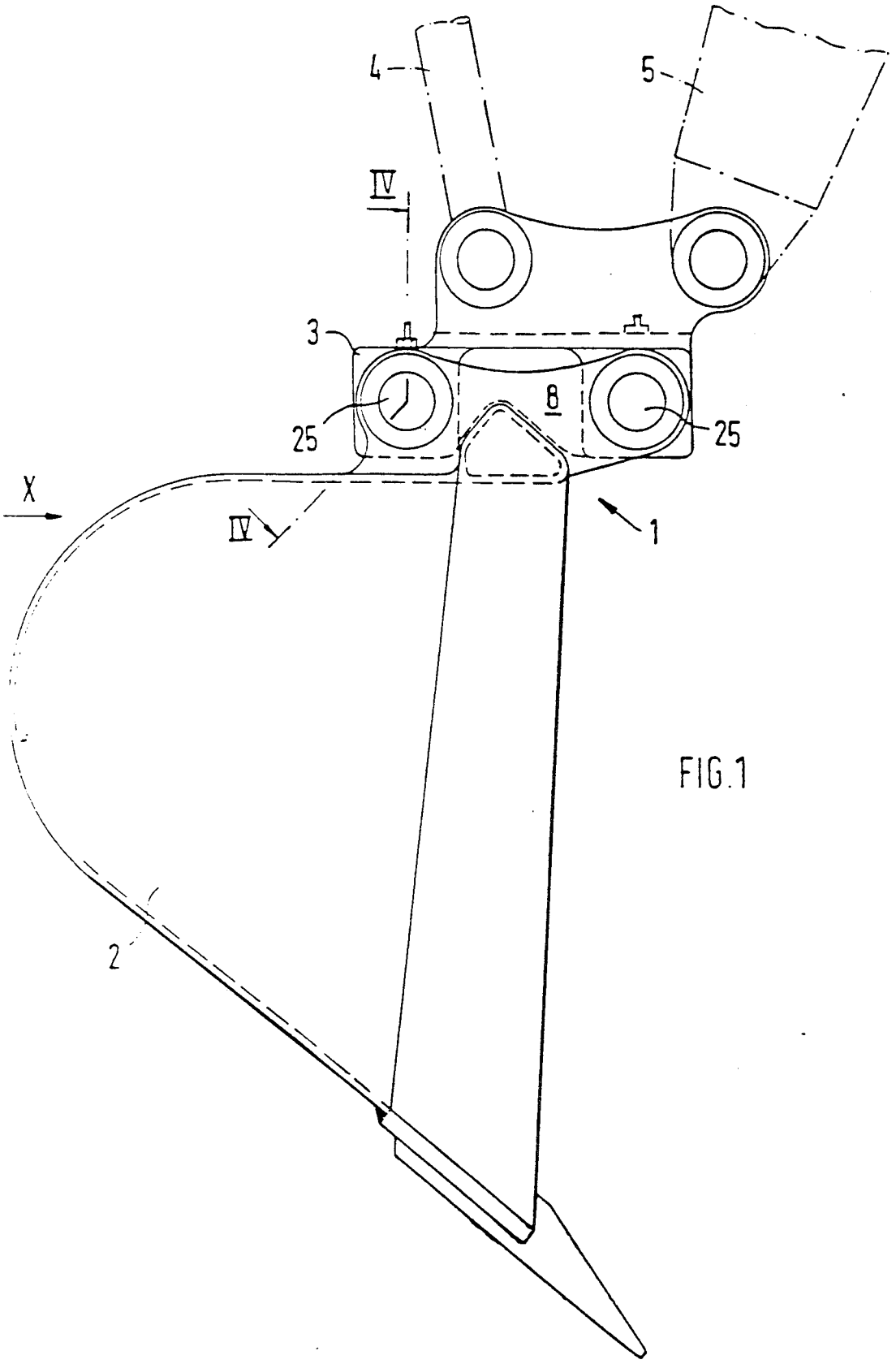
FIG. 1 is a lateral view of a dipper shovel held by way of locking elements on a bending arm and a coupling rod, constructed according to a preferred embodiment of the present invention.
Figure 2:
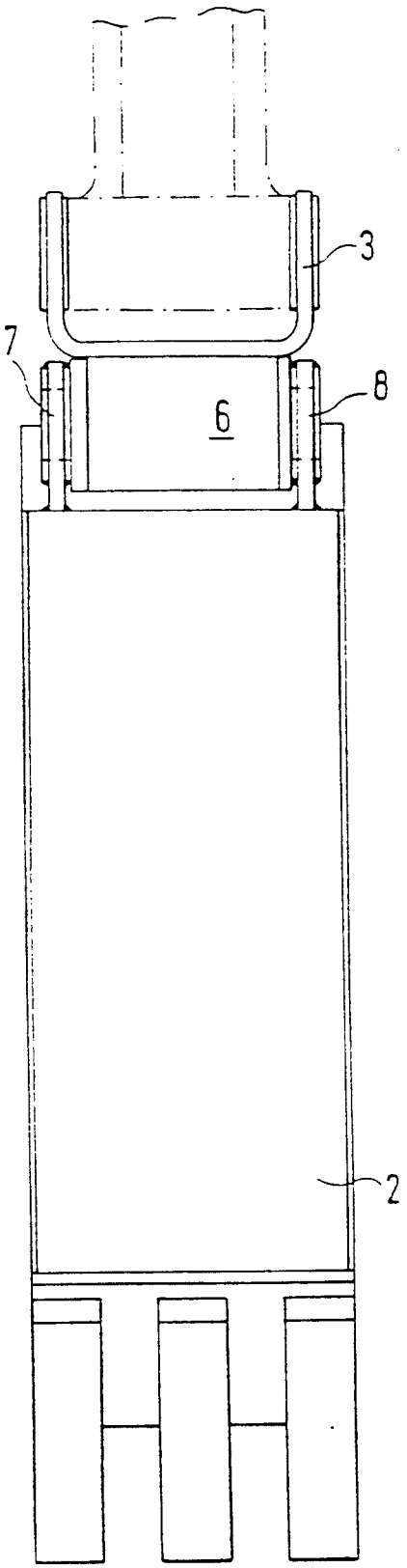
FIG. 2 is a view in the direction of the arrow X of FIG. 1.

A quick-change system 1 for a tool, for example, for a dipper shovel 2, is housed in an adapter 3 which is connected with a coupling rod 4 and a bending arm 5. In the adapter 3, the locking elements 6 are fastened, being arranged between legs 7 and 8 of the dipper shovel 2 for holding purposes.

The locking element 6 comprises pistons 10 and 11 which are coaxially arranged in a cylindrical housing 9 and have locking pins 12 and 13 constructed on the end side. The pair of pistons are fastened in the adapter 3 via screws 50. A pressure spring 14 is arranged between the two pistons 10 and 11 and seeks to push the pistons apart in the directions of the arrow 16.

Figure 4:
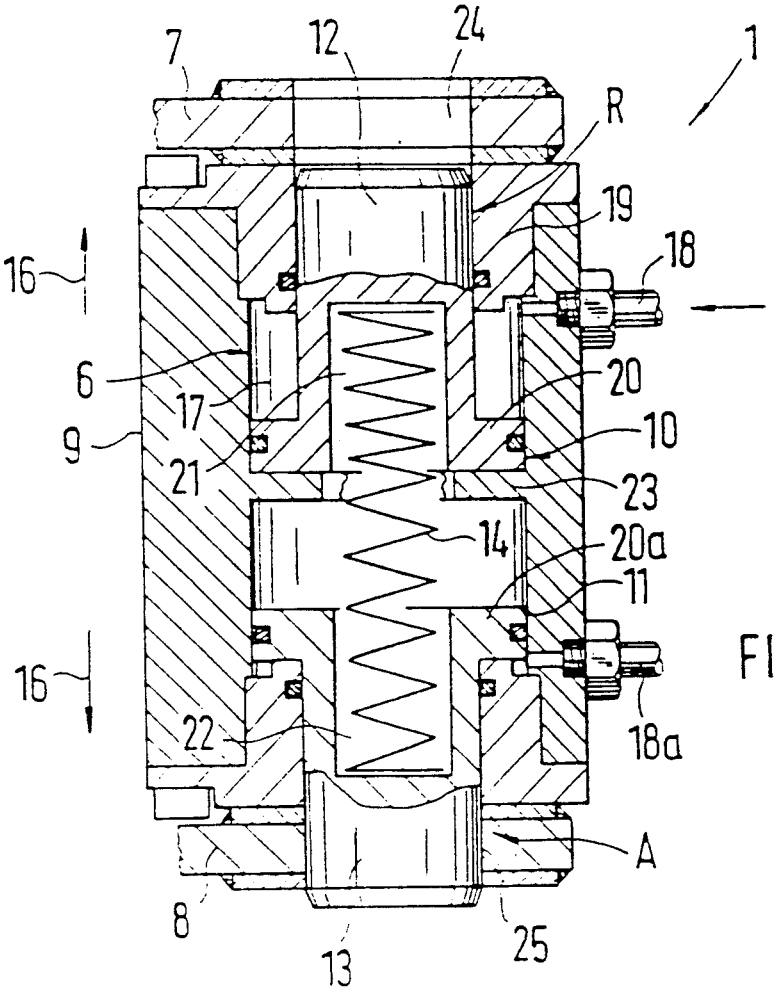
FIG. 4 is a sectional view of a locking element taken along line IV—IV of FIG. 1.

FIG. 4 illustrates such a locking element 6 in which case the locking pin 12, shown in a retracted inoperative position R, and the other locking pin 13 shown in an extended operating position A are shown in one drawing for reasons of simplicity. The locking pins 12 and 13 together always have an identical position A or R during actual operation.

The pistons 10 and 11 are connected with a hydraulic pressure circuit of a control unit 15 in such a manner that the pistons can be displaced from the operating position A into the inoperative position R against the direction of the arrow 16. For this purpose, the pistons 10 and 11 have a pressure space 17 between the locking pins 12 and 13 and the housing 9, one pressure line 18, **18*a* respectively leading into the pressure space 17. On the one side, this pressure space 17 is bounded by a guide sleeve 19 and, on the other side, by a pressure flange 20** of the respective piston.

At the end side, the pressure spring 14 supports itself in pocket bores 21 and 22 of the pistons 10 and 11. It penetrates a transverse center wall 23 on which the pressure flanges 20, 20*a* of the pistons 10 and 11 are supported in the inoperative position R.

As shown in detail in the embodiment according to FIG. 1, two housings 9 with locking elements 6 are arranged in the adapter 3. The locking pins 12, 13 are guided in the sleeve 19 and, in the operating position A, penetrate the bores 24 and 25 in the legs 7 and 8 of the dipper shovel 2.

Figure 6:
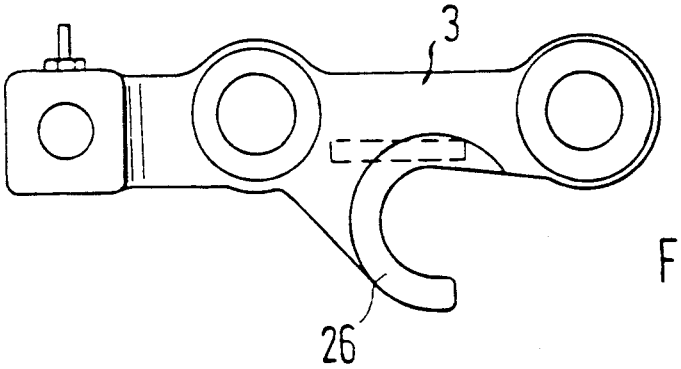
FIG. 6 is a lateral view of an adapter for the case of a system according to FIG. 5.
Figure 5:
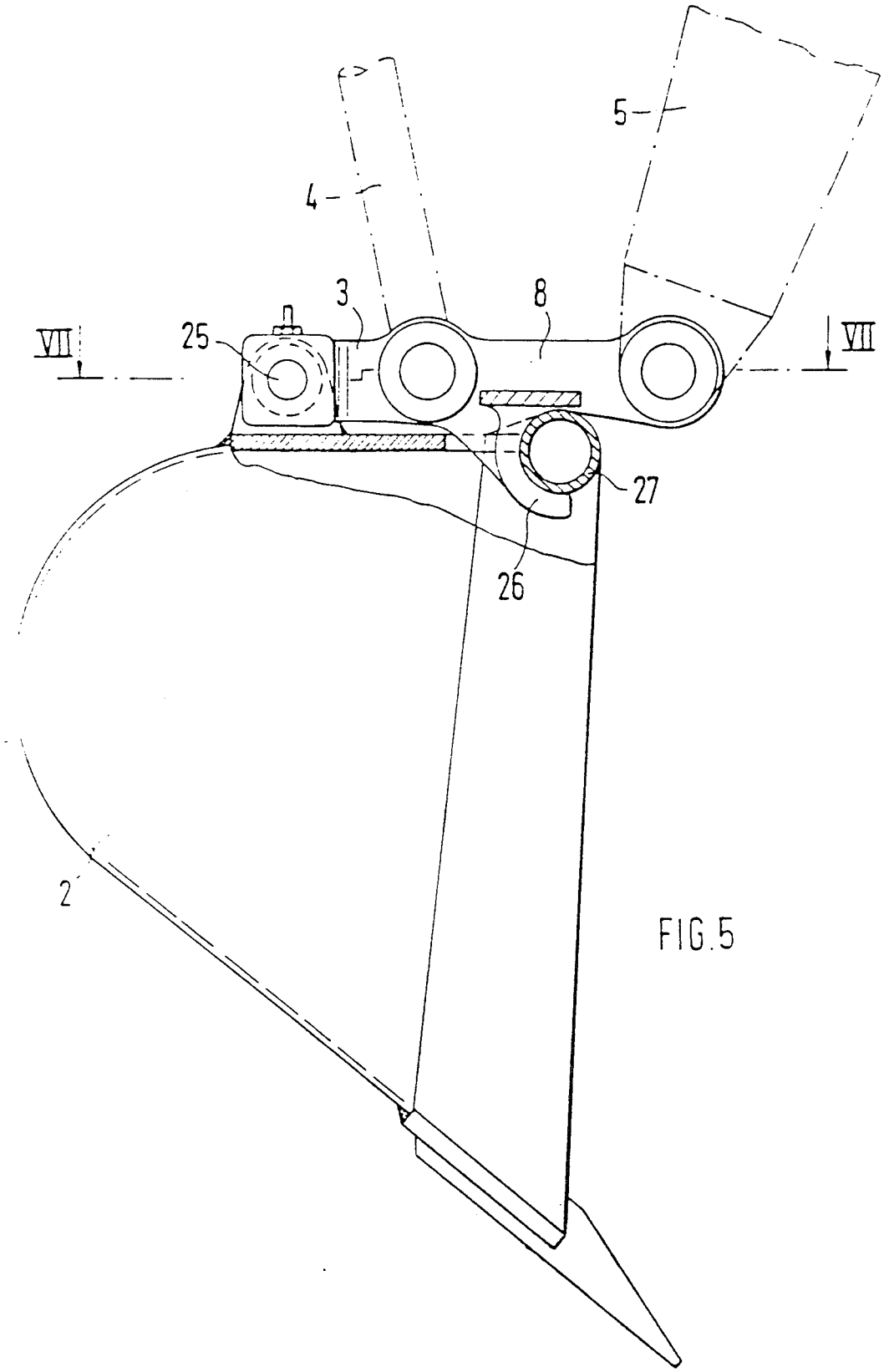
FIG. 5 is a view of another embodiment of a quick-change system having a locking element.
Figure 7:
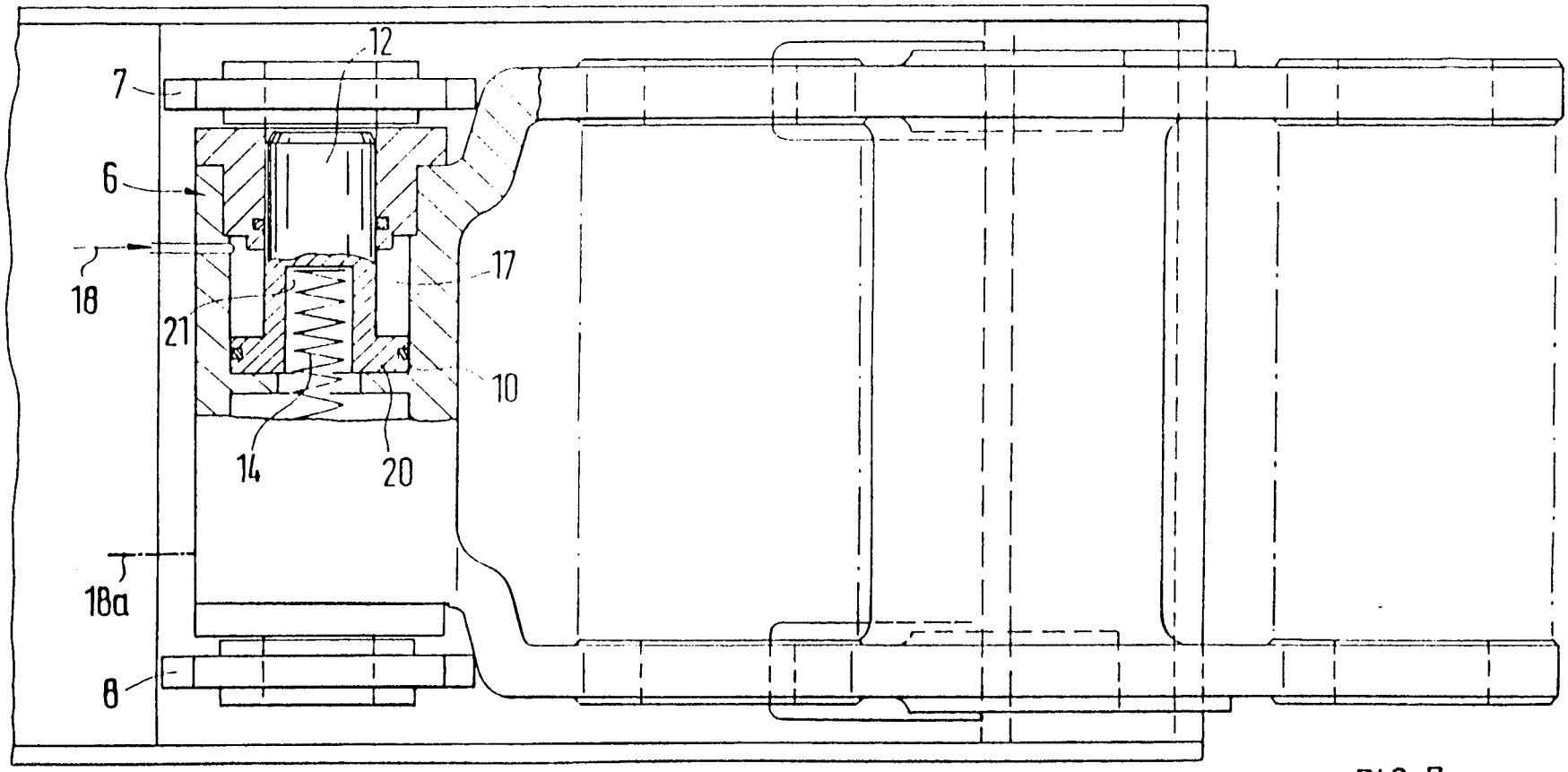
FIG. 7 is a sectional view taken along Line VII—VII of FIG. 5 of the adapter with the locking element.

According to another embodiment according to FIGS. 5 to 7, only one locking element 6 is held in the adapter 3, and the adapter 3 has a hook 26 which reaches under a cam 27 of the dipper shovel 2.

Figure 8:
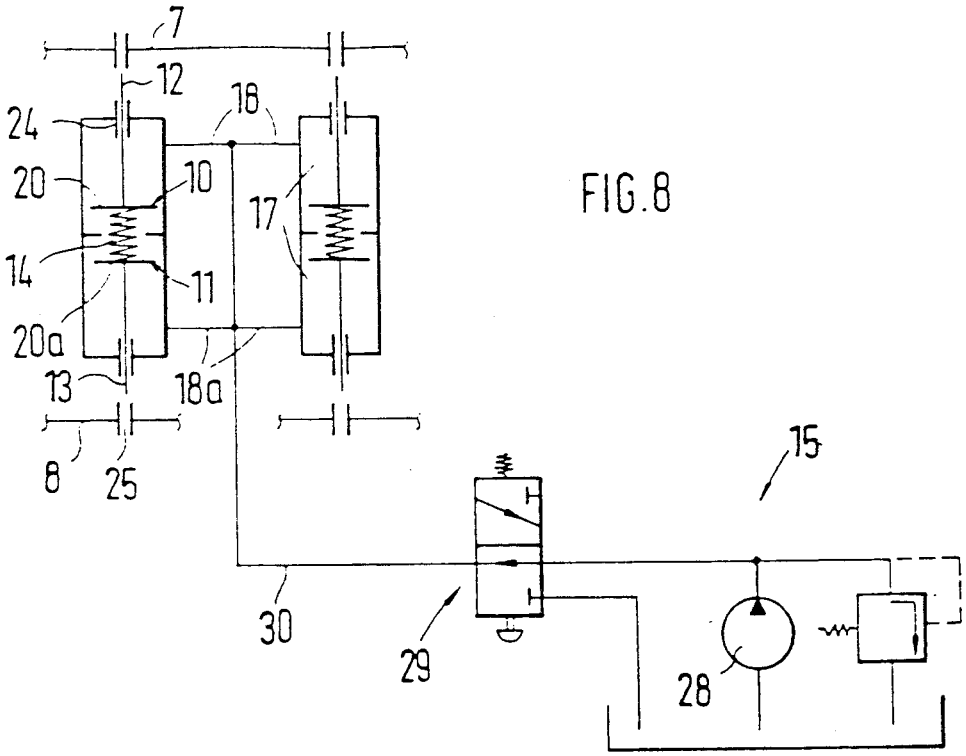
FIG. 8 is a schematic view of a hydraulic operating circuit diagram for two locking units constructed according to a preferred embodiment of the invention.

FIG. 8 illustrates a first possible hydraulic operating circuit diagram for the control of the pistons 10 and 11 into the inoperative position R. This control unit 15 comprises essentially a line 30 guided by a pump 28 by way of a multiple-way valve 29 from which lines 18 and 18*a* branch off to the pressure spaces 17 of the pistons 10 and 11.

Figure 9:
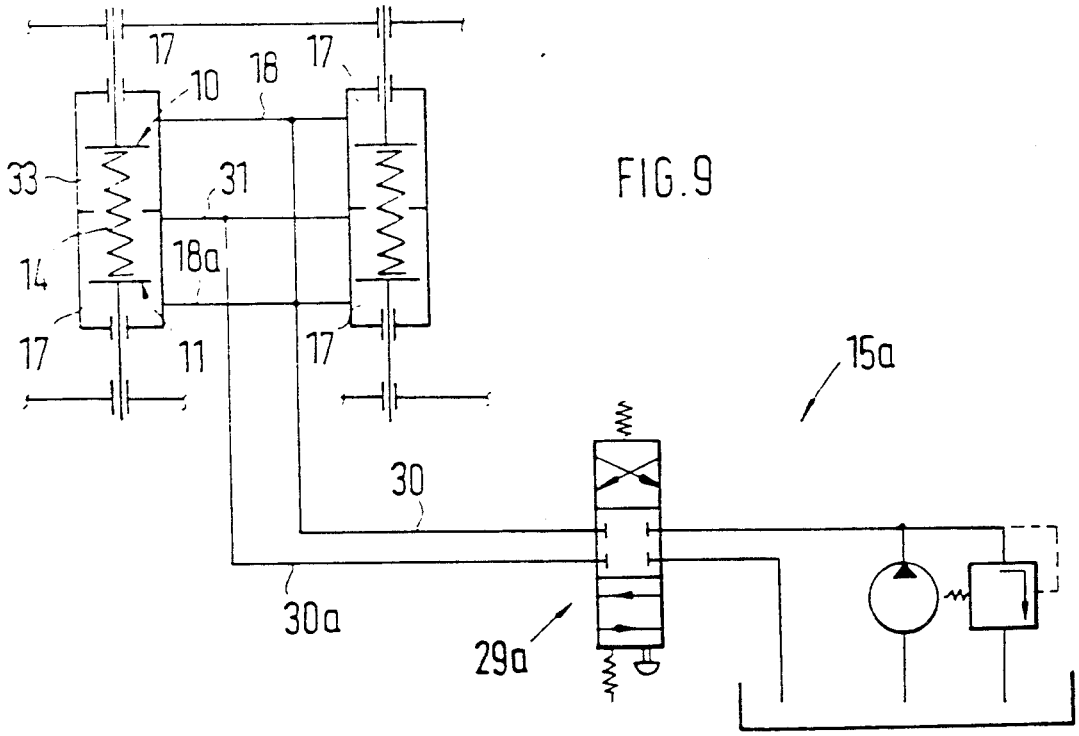
FIG. 9 is a schematic view of another hydraulic operating circuit diagram with a hydraulic pressure support of the pressure spring.

FIG. 9 shows a second possible hydraulic operating circuit diagram for the control of the pistons 10 and 11 into the inoperative position R and for the supporting in the operative position A. The control unit 15*a* comprises two pressure lines 30 and 30*a* branching off from the multiple-way valve 29. The first line 30 has lines 18 and 18*a* leading to the pressure spaces 17. The second line 30*a* has a branching-off line 31 which guides a space 33 between the pistons 10 and 11 and supports a movement of the pistons into a working position A; i.e., the pistons are displaced in the operating direction of the spring 14.

Figure 3:
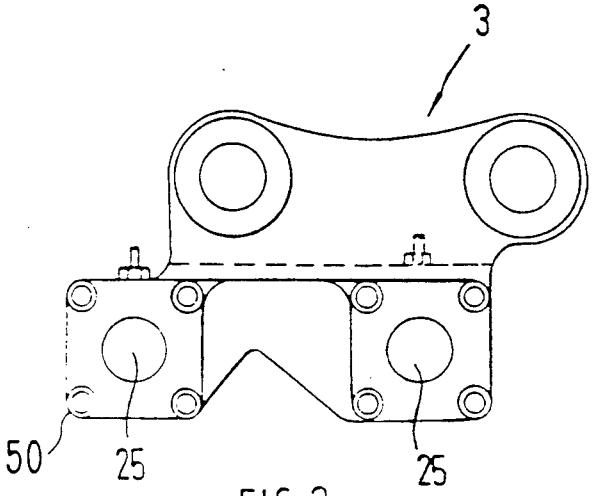
FIG. 3 is a lateral view of an adapter of the embodiment of FIGS. 1 and 2.

The recess in the connecting rib in the adapter 3 (FIG. 3) between the two bores 25 is constructed such that, as a counterpart of the reinforcing profile at the dipper shovel 2, it permits a prefixing during the "coupling operation".

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A quick-change arrangement for an excavator allowing an exchange of tools detachably fastened to an adapter of a bending arm, said tools being held on the bending arm in a manner allowing the tools to swivel about a horizontal axis, the arrangement comprising:

a locking means for detachably fastening the tools to the adapter, said locking means including a housing having a transverse center wall;

a pair of pistons coaxially arranged in the housing, said pistons each having a pocket bore facing opposite one another, and a locking pin formed on an outer-end thereof;

a pressure spring interposed between said pistons through the transverse center wall and being supported within each pocket bore of said pistons, said pressure spring operating axially for adjusting said locking pins into a moved-out operative position; and a control unit for controlling a pressure admission to said pistons for adjusting said locking pins into a moved-in inoperative position.

2. An arrangement according to claim 1, wherein two locking means are provided, each pair of pistons being arranged next to one another in their respective housings within the adapter and being fastened in the adapter via screws;

wherein said tools each include legs having bores formed therethrough, said legs extending around the adapter allowing the bores to correspond with the locking pins.

3. An arrangement according to claim 2, wherein the pistons each have a connecting pressure flange with a larger diameter than the locking pins, and further including guide sleeves for closing off each housing;

a pressure line; and an annular pressure space formed between the pressure flange of each of the pistons and its respective guide sleeves wherein the pressure line leads into each pressure space.

4. An arrangement according to claim 3, wherein the control unit comprises:

an operable distributing valve arranged in the pressure line, said pressure line branching-off into branch lines leading into the annular pressure space of each of the pistons.

5. An arrangement according to claim 2, wherein the control unit includes first and second pressure line branching-off from an operable distributing valve, the first pressure line including first branch lines leading to pressure spaces of the coaxially arranged pistons, and the second pressure line leading into a space provided between each pair of pistons.

6. An arrangement according to claim 5, wherein the space between each pair of pistons is another pressure space such that the pistons can be displaced into the moved-out operative position.

7. An arrangement according to claim 1, wherein the adapter includes hooks, said hooks engaging with a cam formed on the tools; and wherein the locking means is arranged adjacent a bearing site for a coupling rod connected to the adapter.

8. An arrangement according to claim 1, wherein the pistons each have a connecting pressure flange with a larger diameter than the locking pins, and further including:

guide sleeves for closing off the housing;

a pressure line; and an annular pressure space formed between the pressure flange of each of the pistons and the guide sleeves wherein the pressure line leads into the pressure space.

9. An arrangement according to claim 8, wherein the control unit comprises:

an operable distributing valve arranged in the pressure line, said pressure line branching-off into branch lines leading into the annular pressure space of each of the pistons.

10. An arrangement according to claim 1, wherein the control unit includes first and second pressure lines branching-off from an operable distributing valve, the first pressure line including first branch lines leading to pressure spaces of the coaxially arranged pistons, and the second pressure line leading into a space provided between the pair of pistons.

11. An arrangement according to claim 10, wherein the space between the pair of pistons is another pressure space such that the pistons can be displayed into the moved-out operative position.

* * * * *